United States Patent [19]

Lovrenich

[11] Patent Number: 4,812,731

[45] Date of Patent: Mar. 14, 1989

[54] CLAMP ACTUATED BY INDUCTION MOTOR

[76] Inventor: Rodger T. Lovrenich, 209 Whispering Sands, Santa Teresa, N. Mex. 88008

[21] Appl. No.: 918,899

[22] Filed: Oct. 15, 1986

[51] Int. Cl.[4] ..... A02P 5/40

[52] U.S. Cl. ..... 318/800; 318/592

[58] Field of Search ..... 318/798–803, 318/805–811, 110, 626, 561, 106, 108, 109, 466, 468–469; 307/52, 86–87, 85

[56] References Cited

U.S. PATENT DOCUMENTS

| | | | |
|---|---|---|---|
| 3,710,218 | 1/1973 | Roundy et al. | 318/807 |
| 3,962,614 | 10/1974 | Rettig | 318/801 |
| 4,311,951 | 1/1982 | Walker et al. | 318/808 |
| 4,376,471 | 3/1983 | Uchino et al. | 187/114 |
| 4,459,533 | 7/1984 | Ehret et al. | 318/807 |
| 4,503,371 | 3/1985 | Sugita | 318/443 |
| 4,524,310 | 6/1985 | Nagase et al. | 318/808 |
| 4,559,485 | 12/1985 | Whited | 318/802 |
| 4,571,499 | 2/1986 | Wein | 307/85 |
| 4,665,323 | 5/1987 | Russell et al. | 307/86 |

*Primary Examiner*—William M. Shoop, Jr.
*Assistant Examiner*—D. Martin
*Attorney, Agent, or Firm*—Lisa & Kubida

[57] ABSTRACT

A workpiece clamp actuator system which includes a clamping mechanism and an induction motor having an output coupled to the clamping mechanism for moving the mechanism between an unclamped position in abutment with a stop and a clamped position in abutment with a workpiece. A motor controller selectively feeds energy from first and second power supplies to the induction motor, the first power supply having an output voltage and frequency selected to obtain rapid initial motion at the clamp, and the second power supply having an output frequency equal to the slip frequency of the motor at rated torque and an output voltage selected to provide full load current, and thus maximum torque, at both the clamped and unclamped positions.

5 Claims, 2 Drawing Sheets

CLAMP ACTUATED BY INDUCTION MOTOR

The present invention relates to an induction motor system for driving a load, and more particularly to automatic clamping devices which cycle between clamp and unclamp positions relative to a workpiece.

BACKGROUND AND OBJECTS OF THE INVENTION

Automatic clamping mechanisms are extensively employed in production lines such as transfer lines. In a typical transfer line, various machining operations, such as drilling, boring, milling or gauging, may be performed on a workpiece at sequential work stations to yield a finished part. The workpieces at the various work stations are clamped simultaneously, machined or otherwise worked upon, unclamped, and transferred simultaneously to the next stations in the sequence. The workpiece clamps are initially moved rapidly in rapid approach to a location near the fully clamped or unclamped position, and then are fed more slowly to the final positions. Various devices such as hydraulic actuators are conventionally employed to perform the clamping and unclamping functions. Such actuators are expensive, are subject to failure, and are difficult to control, tending to slam the clamp against the clamp stop in the open position and/or into the workpieces in the clamped position.

It is a general object of the present invention, therefore, to provide a clamping arrangement character which overcomes the aforementioned deficiencies in the art. More specific objects of the invention are to provide such a clamping arrangement which is easy to control and which firmly holds the clamp against the workpieces and/or the clamp stop.

SUMMARY OF THE INVENTION

In accordance with the present invention, it has been found that an induction motor may be caused to deliver rated torque at full load current and zero velocity—i.e., at stall—by driving the motor at a frequency equal to the slip frequency at rated load. Stated differently, an induction motor possesses a maximum no-load velocity which depends upon design frequency and number of poles, such as 1800 rpm for a four-pole 60 Hz motor. However, at full load current and rated torque, the motor runs at a lesser velocity, with the difference being the slip speed (or corresponding slip frequency) of that motor. It has been observed in accordance with the present invention that, when the motor is driven at such slip frequency, the motor delivers rated torque at zero velocity without exceeding the full load current.

A preferred embodiment of the present invention overcomes the aforementioned deficiencies in the art with a clamping mechanism that employs an induction motor and two electrical power supplies for actuating the clamping device. One power supply causes the induction motor to move the clamping device at high speed during initial clamping and unclamping motions. The other power supply possesses a frequency which is equal to the slip frequency of the induction motor and a voltage which supplies full load current at stall of the induction motor. The second power supply thus moves the clamp more slowly to the final fully opened or fully clamped position without slamming the clamp into the clamp stop or the workpiece, and firmly holds the clamp against the stop or workpiece at full rated torque.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
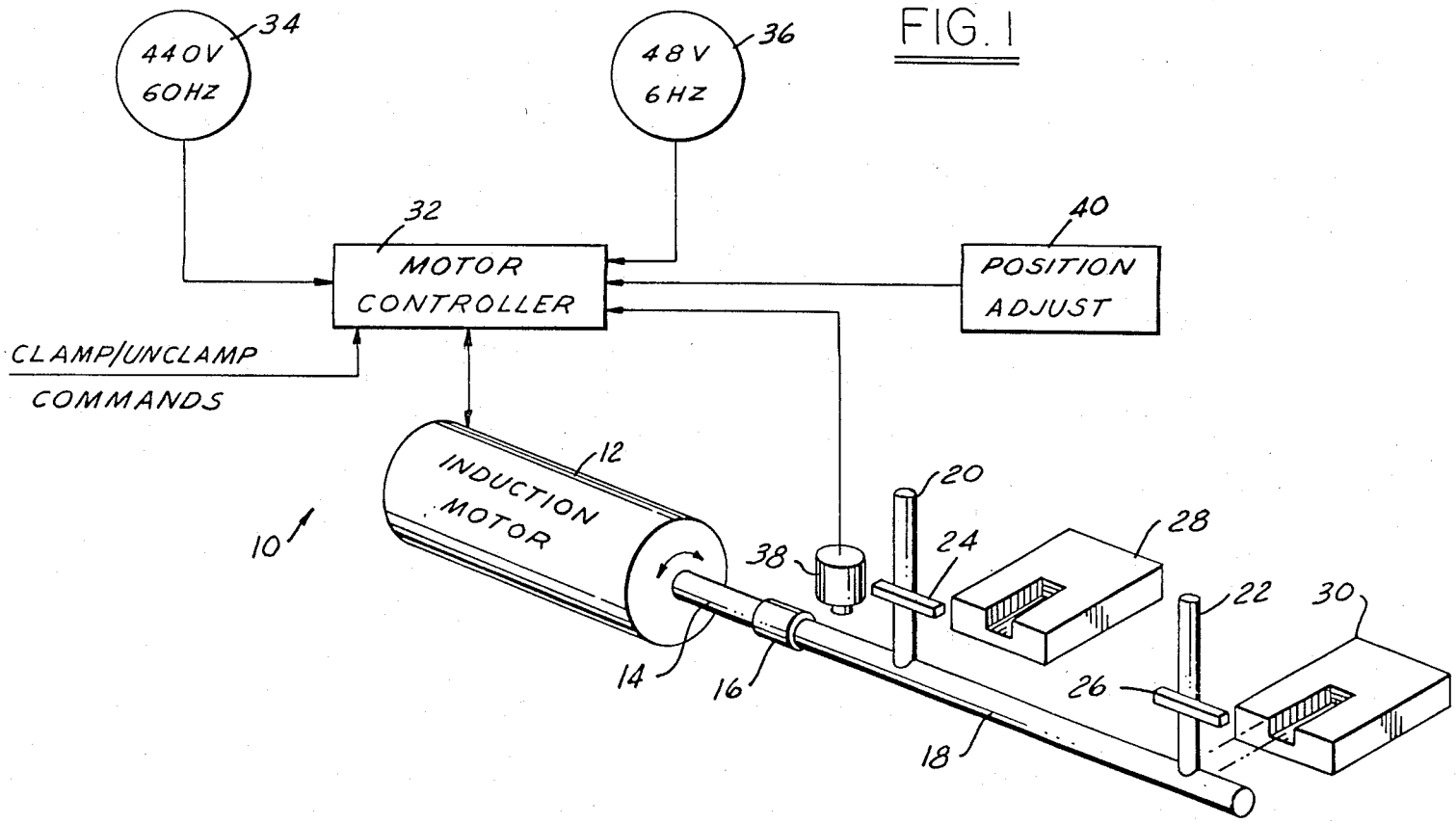
FIG. 1 is a functional block diagram of a presently preferred embodiment of the invention.

Referring to the drawings, a presently preferred embodiment 10 of a clamp actuator system in accordance with the invention comprises an induction motor 12 having an output shaft 14 connected through a coupler 16 to a rotatable clamp shaft 18. Clamp shaft 18 extends longitudinally through a plurality of work stations, only two of which are illustrated in the drawing. A multiplicity of clamp arms 20, 22 project radially from clamp shaft 18 and are rotatable thereby between fully opened positions in engagement with clamp stops 24, 26 and fully closed positions in clamping engagement with workpieces 28, 30. It will be appreciated, of course, that the clamps and workpieces are illustrated essentially schematically in the drawings, and may take any one of a multiplicity of suitable forms. Likewise, the arc of travel of the clamp arms 20, 22 may vary depending upon the workpieces and clearances involved.

A motor controller 32 receives power inputs from a first power supply 34 and a second power supply 36, and selectively connects one of such power supplies to the windings of induction motor 12. First power supply 34 possesses an output voltage and frequency selected as a function of the rated speed and torque of induction motor 12 for providing initial rapid motion at the clamp away from the clamp or unclamped position. Second power supply 36 has an output frequency which is equal to the slip frequency of induction motor 12 at rated torque, and has an output voltage selected to produce full rated stall current in motor 12, and thus full rated torque, when clamp arms 20, 22 are engaged with stops 24, 26 or workpieces 28, 30. Motor controller 32 also receives clamp/unclamped commands from an external source (not shown) and clamp position signals from a suitable sensor 38. Sensor 38 may comprise limit switches, proximity switches or the like for detecting approach of clamp shaft 18 and/or clamp arms 20, 22 to the fully clamped or unclamped position, and for thereby signaling controller 32 to switch from the first or rapid feed power supply 34 to the second or final feed supply 36. Controller 32 also receives an input from an operator position adjustment 40, such as variable resistors or the like, for empirically adjusting supply-switchover positions so that the clamp arms engage the stops or workpieces without slamming thereagainst.

Figure 2:
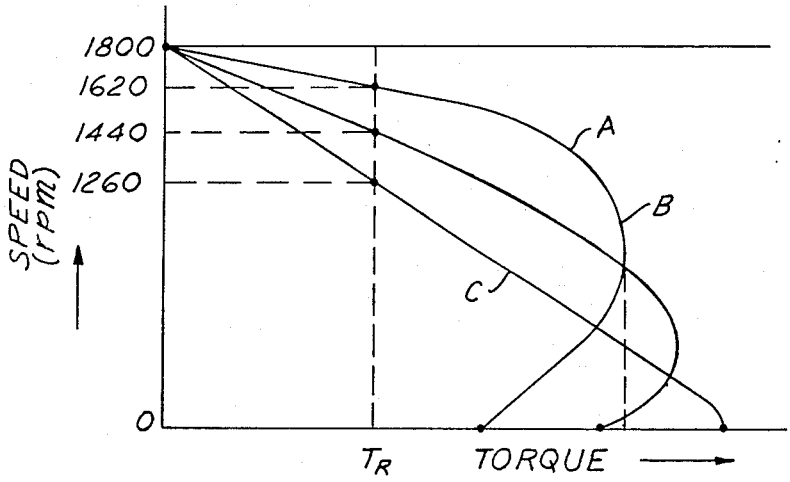
FIGS. 2 and 3 are graphic illustrations useful in describing operation of the invention.
Figure 3:
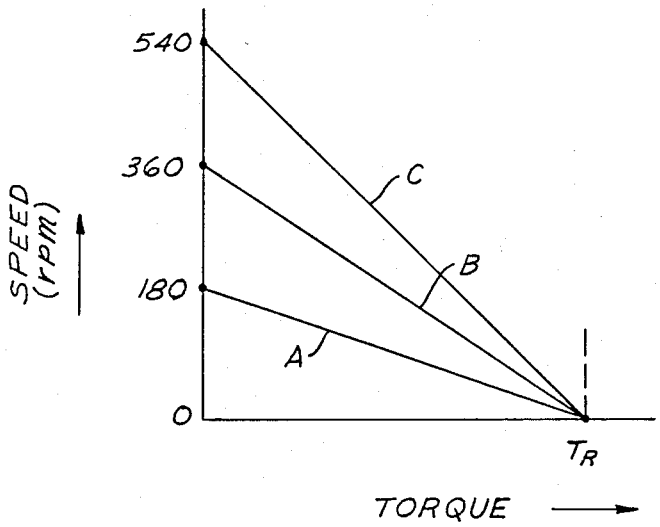

Theory of operation will be best understood with reference to FIGS. 2 and 3. FIG. 2 illustrates typical speed/torque characteristic curves A, B and C for so-called Class A, Class B and Class C induction motors. It is assumed for purposes of discussion that all three motors possess identical numbers of poles and design frequencies—e.g., four poles and 60 Hz—so that all motors have identical no-load speeds close to 1800 rpm. As load is applied, velocities of all three motors drop, initially substantially linearly, as a function of load toward rated torque for that motor at which the motor draws full load current. For purposes of comparison, it is assumed that all motors have identical rated torque $T_R$. Beyond rated torque, speed continues to drop and load current increases toward stall (zero speed). Note that in each exemplary motor, stall current is greater than full load current.

At rated torque $T_R$, each motor has a slip speed which is inherent in the motor design, and which is equal to the difference between full load speed and the design no-load limit (1800 rpm in these examples). Thus, for exemplary motor A, the slip speed at rated torque is 180 rpm (10%), corresponding to a slip frequency of 6 Hz. For exemplary motor B, the slip speed and frequency are 360 rpm and 12 Hz, and for motor C 540 rpm and 18 Hz.

FIG. 3 graphically illustrates the no-load to rated torque portion of curves A, B and C in FIG. 2 translated so as to intersect at rated torque $T_R$ and zero speed. Each curve in FIG. 3 thus exhibits a no-load speed corresponding to the slip speed at rated torque in FIG. 2. Thus, if motor A is driven at 6 Hz, it will possess a no-load speed close to 180 rpm, and will deliver rated torque at full load current at stall. Thus, the motor may be driven indefinitely to deliver rated torque at stall. Likewise, motor B will deliver rated torque at stall if driven at 12 Hz (with a corresponding no-load speed approaching 360 rpm), and motor C will deliver rated torque at stall if driven at 18 Hz (with a corresponding no-load speed approaching 540 rpm). In each case, drive voltage is selected empirically to deliver full load current at stall. Note that all of the motors in this example deliver the same rated torque $T_R$ at stall, and may be selected as a function of desired speeds during each portion of the drive cycle.

Thus, the invention broadly contemplates first and second power supply means coupled to an induction motor for driving a load. Such first and second power supply means may comprise separate supplies as in FIG. 1, or separately selectable operating modes of a single supply. The first power supply means operate at the motor design frequency (e.g. 60 Hz) and possess an output voltage (e.g. 440 v) selected to deliver full load current at rated torque. The second power supply means operates at the slip frequency of the motor (e.g. 6 Hz) when driven at design frequency and voltage, and possesses an output voltage (e.g. 48 v) selected to deliver full load current at stall. A motor controller or the like selects between the first and second power supply means to achieve rapid initial motion at the load by coupling to the first supply, followed by slower load motion toward the final position and application of rated torque at stall. The disclosed implementation for actuating a workpiece clamp is exemplary but preferred.

The invention claimed is:

1. An induction motor system for driving a load comprising an induction motor having an electrical power input and an output for driving a load toward an abutment position, said motor having a predetermined design drive frequency and voltage for obtaining full load current at rated torque and having an inherent slip frequency at rated torque, first power supply means having an output frequency and voltage equal to said design drive frequency and voltage, second power supply means having an output frequency equal to said slip frequency and an output voltage coordinated with said slip frequency and with rated torque of said motor to deliver full load current at rated torque, sensor means for determining load position, and control means for selectively alternatively connecting said first and second power supply means to said motor power input, said control means being responsive to said sensor means for connecting said first power supply means to said motor input to drive said load toward said abutment position, and for connecting said second power supply means to said motor input for obtaining rated torque at full load current to hold the load in said abutment position.

2. An induction motor actuated clamp system for holding a load against fixed abutment means comprising an induction motor having an input for receiving electrical power and an output for coupling to a load, said induction motor having an inherent slip frequency at full load current and rated torque, means coupling said motor output to a load for clamping said load against said abutment means, and an electrical power supply coupled to said motor input, said power supply having an output frequency equal to said inherent slip frequency and an output voltage such that said motor delivers rated torque to said load through said clamping means at full load current and zero velocity.

3. An induction motor actuated clamp for clamping a workpiece in position, comprising:

inducting motor means having a rotatable shaft, clamp means coupled to said induction motor shaft and movable between fully clamped and fully unclamped positions, stop means for seating the clamp means in the fully unclamped position, motor control means electrically connected to said induction motor means, fast power supply means electrically connected to said motor control means and to said induction motor means for rotating said motor shaft and moving said clamp means rapidly from a fully unclamp position against said stop means toward a workpiece clamp position and from a fully clamped position against a workpiece toward said stop means; and slow power supply means electrically connected to said motor control means and said induction motor means for rotating said induction motor shaft and moving said clamp means at a slower rate to fully clamped and fully unclamped positions, said induction motor means having a slip frequency equal to the slow power supply frequency and stalling at rated torque and full load current in the fully clamped and fully unclamped positions.

4. An induction motor actuated clamp according to claim 3 wherein the clamp means is rotatable in an arc between the fully clamped and fully unclamped positions.

5. An induction motor actuated clamp according to claim 3 wherein the clamp means comprises a clamp bar rotated by said induction motor means, and clamp finger means extend from said clamp bar for engaging parts to be clamped.

* * * * *